US012280470B2

(12) United States Patent
Schumacher et al.

(10) Patent No.: US 12,280,470 B2
(45) **Date of Patent: *Apr. 22, 2025**

(54) ABRASIVE BELT GRINDING PRODUCT

(71) Applicant: Mirka Ltd, Jeppo (FI)

(72) Inventors: Nicolas Schumacher, Inga (FI); Jan Grön, Vörä (FI); Niina Kyynäräinen, Salo (FI); Hans Hede, Vörä (FI); Mats Sundell, Hirvlax (FI)

(73) Assignee: Mirka Ltd, Jeppo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 18/395,559

(22) Filed: Dec. 23, 2023

(65) Prior Publication Data

US 2024/0123573 A1 Apr. 18, 2024

Related U.S. Application Data

(63) Continuation of application No. 15/570,307, filed as application No. PCT/EP2015/060186 on May 8, 2015, now Pat. No. 11,890,723.

(51) Int. Cl.
*B24D 11/00* (2006.01)
*B24D 3/00* (2006.01)
(Continued)

(52) U.S. Cl.
CPC ..... *B24D 11/00* (2013.01); *B24D 3/002* (2013.01); *D04B 21/10* (2013.01); *D06N 3/0009* (2013.01);
(Continued)

(58) Field of Classification Search
CPC ..... B24D 3/004; B24D 3/002; B24D 11/00; B24D 11/005; B24D 11/02; B24D 11/001;
(Continued)

(56) References Cited

U.S. PATENT DOCUMENTS 2,984,052 A 5/1961 Mueller, Jr.
3,861,892 A 1/1975 Wisdom, Jr. et al.
(Continued)

FOREIGN PATENT DOCUMENTS

EP 0779851 A1 3/1996
EP 1522386 B1 3/2006
(Continued)

OTHER PUBLICATIONS

International Search Report and Written Opinion for PCT/EP2015/060186 Mailed Feb. 26, 2016, 10 pages.
(Continued)

*Primary Examiner* — Robert F Neibaur
(74) *Attorney, Agent, or Firm* — Lowe Graham Jones PLLC

(57) ABSTRACT

An abrasive belt is provided which comprises a textile fabric being formed of interconnected yarns, and a coherent abrasive area formed on one side of the textile fabric, wherein the abrasive belt further comprises a plurality of regularly distributed openings in the form of through holes. The abrasive belt allows for a homogenous distribution of the abrasive material and thus an even sanding finish as well as for an appropriate dust removal and appropriate mechanical properties.

26 Claims, 10 Drawing Sheets

(51) Int. Cl.
*D04B 21/10* (2006.01)
*D06N 3/00* (2006.01)

(52) U.S. Cl.
CPC ..... *D06N 3/007* (2013.01); *D10B 2403/0112* (2013.01); *D10B 2403/0241* (2013.01); *D10B 2403/02421* (2013.01); *D10B 2403/0243* (2013.01); *D10B 2403/0312* (2013.01); *D10B 2505/00* (2013.01)

(58) Field of Classification Search
CPC .. B24D 2203/00; D04B 21/10; D04B 21/165; B10B 2403/0112; B10B 2403/0243; B10B 2403/0241; B10B 2403/02421; B10B 2403/0312; B10B 2403/033; B10B 2505/00
USPC ..... 451/536, 532, 526, 527, 533; 66/192
See application file for complete search history.

(56) References Cited

U.S. PATENT DOCUMENTS

| | | | | |
|---|---|---|---|---|
| 4,282,011 | A | 8/1981 | Terpay | |
| 4,386,943 | A | 6/1983 | Giimebel et al. | |
| 4,725,487 | A | 2/1988 | Pemrick et al. | |
| 4,960,442 | A | 10/1990 | Wagner et al. | |
| 5,317,886 | A * | 6/1994 | Prahl | D04B 21/14 51/295 |
| 5,674,122 | A | 10/1997 | Krech | |
| 5,700,188 | A | 12/1997 | Uhlmann et al. | |
| 5,795,835 | A * | 8/1998 | Bruner | E02B 3/04 442/310 |
| 6,024,634 | A * | 2/2000 | Hoglund | B24D 11/005 451/526 |
| 6,672,952 | B1 | 1/2004 | Masmar et al. | |
| 6,923,840 | B2 | 8/2005 | Schutz et al. | |
| 7,252,694 | B2 * | 8/2007 | Woo | B24D 3/002 451/526 |
| 7,438,635 | B2 | 10/2008 | Hoglund | |
| 8,056,373 | B2 * | 11/2011 | Kazuma | E06B 9/266 66/196 |
| 8,057,287 | B2 | 11/2011 | Chao et al. | |
| 8,216,030 | B2 | 7/2012 | Hoglund | |
| 9,326,840 | B2 * | 5/2016 | Mortarino | A61L 27/3604 |
| 10,421,173 | B2 | 9/2019 | Lin et al. | |
| 2007/0002852 | A1 | 2/2007 | Woo et al. | |
| 2008/0229672 | A1 | 9/2008 | Woo | |
| 2011/0159794 | A1 * | 6/2011 | Chung-Fat | B24B 55/06 451/527 |
| 2013/0327433 | A1 | 12/2013 | Litchfield et al. | |
| 2015/0174736 | A1 | 6/2015 | Sathyanarayanaiah et al. | |
| 2016/0184974 | A1 | 6/2016 | Srihari et al. | |

FOREIGN PATENT DOCUMENTS

| | | | |
|---|---|---|---|
| EP | 1733844 | B1 | 4/2009 |
| EP | 2042269 | A1 | 4/2009 |
| EP | 2390056 | A2 | 11/2011 |
| EP | 1939342 | B1 | 10/2012 |
| GB | 2017485 | A | 10/1979 |
| JP | H214039 | A | 1/1990 |
| RU | 2385799 | C2 | 4/2010 |
| RU | 2456393 | | 7/2012 |
| WO | 2014037034 | A1 | 3/2014 |

OTHER PUBLICATIONS

Australian Examination Report dated Dec. 3, 2018 for co-pending Australian Patent Application No. 2015394604; pp. 4.
Russian Office Action dated Dec. 7, 2018 with English summary for co-pending Russian Patent Application No. 2017142717; pp. 12.
South Korean Office Action dated Jan. 7, 2019 with English summary for co-pending South Korean Patent Application No. 10-2017-7033793; pp. 16.
European Examination Report dated Feb. 20, 2019 for co-pending European Patent Application No. 15722167.2; pp. 5.
Office Action dated Oct. 5, 2021 for co-pending Canadian Patent Application No. 2,983,478; pp. 4.

* cited by examiner

ABRASIVE BELT GRINDING PRODUCT

PRIORITY CLAIM

This application is a continuation of U.S. patent application Ser. No. 15/570,307 filed Oct. 27, 2017, which is a US national phase of PCT/EP15/60186 filed May 8, 2015, the contents of which is incorporated herein by reference.

FIELD OF THE INVENTION

The present invention relates to abrasive products, in the form of abrasive belts, abrasive belt grinding products or corresponding conversion forms.

TECHNOLOGICAL BACKGROUND

Abrasive belts belong to the category of abrasive products having an extensive use in both handheld and stationary apparatus of various designs and in different setups where the advantage is that an endless and homogenous abrasive area can be utilized for grinding, sanding, finishing or polishing of metal, paint, plastic and wood as well as lacquered surfaces and so forth.

The backings of abrasive belts are typically paper or fabric and should fulfil certain requirements regarding their mechanical properties and functionality. The longitudinal elongation needs to be kept low and the strength in the transverse direction should be sufficient for the actual product applications.

The applications for abrasive belts are in most cases related to excessive dust formation and one limiting issue in the use of this type of abrasives is the clogging when the formed dust and other particles are not removed from the working area. Removal of dust and other particles is hindered if the backing material has a closed surface. Especially sanding materials like wood, plastics and filler-rich paints create a high amount of dust and the use of traditional belt products with closed backing materials of woven fabric and paper presents a significant disadvantage.

As far as the use of abrasive belts generally provides a high abrasion rate and good sanding performance, this will result in a tendency of clogging and overheating. In worst situations, this might lead to burn marks on the sanded material and significantly deteriorate the abrasion result. Secondary disadvantageous effects are impaired working conditions, shortening of the lifetime of the abrasives and, accordingly, also an increased need of maintenance interrupts.

The current state of the art is to remove the formed dust by using a dust extraction device which is positioned close to the end of the sanding area in order to remove as much of the dust as possible. Commonly used are also devices which blow compressed air or a cleaning gas onto the surface of the belt and extract the particles from the belt surface by means of a vacuum extraction or similar.

It is not possible to extract dust directly through the sanding belt with such a configuration as far as conventional sanding belts with a closed structure are used. This applies for abrasive belts having a woven fabric, paper or film backing. Simply providing these belts with through holes will in most cases not be effective since, at the same time, certain mechanical requirements have to be met. Accordingly, not more than a very limited number of holes can be implemented into the paper, woven fabric or film backing without causing a drastic and undesired reduction in the tensile strength and durability of the belt. By consequence, the perforations are limited in size and number and perforated belts made of these backing materials generally do not provide an efficient dust extraction.

Clogging due to enrichment of grinding dust is a major problem in the use of most abrasive products, in general, but especially in the sanding of materials like wood, plastics and filler rich paints. Sanding of these materials does create a high amount of dust when using traditional belt products with backing materials of woven fabric and paper.

Specifically, regarding the dust removal, US 2005/020190 and U.S. Pat. No. 6,923,840 describe abrasive products with open cell backings. However, since the open foam structure is attached to a continuous film backing, dust will be accumulated in the openings. In EP 1 733 844 cavities are created in the abrasive backing material. Although these approaches allow larger amounts of dust to be accumulated in the cavities or openings, after a certain amount of time, these areas will inevitably clog as well.

U.S. Pat. No. 2,984,052 describes a woven fabric with regularly interlaced yarns having an abrasive coating. However, the abrasive areas are limited to regularly distributed protuberances or islands. Such structure is not suited for abrasive belt applications since the regularly distributed islands will result in a given stripe-like pattern of the sanded surface. This might be desired in some specific products but in most sanding applications, a finish with an evenly sanded surface is of outermost importance.

The same behavior applies to a belt which is made from a textile backing, like for instance the abrasive described in EP 0 779 851. The described zig-zag structure of tricot-based beams in the running direction is not interconnected across the belt by other surfaces covered with abrasive particles. With other words there are "empty" areas across the belt where the connecting yarns between the beams are located below the beams covered with abrasive particles. This will result in an abrasive effect only from the tricot-based beams which are in contact with the surface. By consequence, the tricot based beams can induce a structure on the surface. A similar effect can occur if the pressure applied on the supporting backing of the belt is unevenly distributed on the sanded surface.

Another way of improving the dust removal is to utilize or even increase the height differences in the surface of the abrasive material. This can be achieved by arranging the grain materials in a structured manner, for instance, in the form of dots or islands like in EP 2 390 056. If transferred to an abrasive belt, such approach will lead to an uneven sanding finish, however. Moreover, the areas between islands will clog after some time, as well.

U.S. Pat. No. 5,674,122 describes a screen abrasive intended for abrasive discs and sheets with a patterned array of a plurality of openings in the backing. The backing characteristically has distinct zones with different surface areas. Accordingly, across the abrasive product, this would result in an inhomogeneous grain distribution at the surface. By consequence, if this inhomogeneous grain distribution pattern is used in an abrasive belt product, stripes in the sanded surface would result.

Another example of an open structure abrasive is provided in EP 1 522 386 where an abrasive product comprising two layers of parallel yarns running in both grinding and traverse directions is disclosed. This solution is functional but when pressure is applied to the construction, the warp yarns will lead to an uneven sanding pressure distribution on the weft yarns which are covered with abrasive particles and thus lead to a structuring of the sanded surface.

EP 0 779 851 describes an open mesh cloth of woven or knitted yarns equipped with abrasive particles. The invention relates more specifically to a structure based on abrasive loops or yarns distributed at the surface. The concept of the invention allows grinding dust to be removed, but the surface structure of the abrasive article is rough and the abrasive areas are located spot-wise. The construction of the abrasive material is also related to issues with the mechanical strength, which would not make the product suitable for belt applications.

For abrasive belts the requirements regarding the dust removal conflict with the need to modify the backing material in order to achieve the desired mechanical properties. Sufficient stiffness is, for instance, achieved by impregnation with suitable resins like in U.S. Pat. No. 4,386,943. Sufficient mechanical strength has also been claimed to be reached in U.S. Pat. No. 5,700,188 by applying a construction in different layers.

SUMMARY

It is an object of the invention to provide an abrasive belt grinding product having an improved grinding performance and an excellent durability.

The object is solved with the abrasive belt according to claims 1, 21 and 23. The dependent claims define preferred embodiments, wherein all of these embodiments are intended to be combinable with one another, as long as they do not contradict each other.

In particular, an abrasive belt comprises a textile fabric formed of interconnected fabric yarns, and a coherent abrasive area formed on one side of the textile fabric. Further, the abrasive belt comprises a plurality of regularly distributed openings in the form of through holes.

Thereby, the expression "interconnected" means that the fabric yarns at least cross one another at interconnection points. Preferably, the interconnection is formed in the form of entanglements when one fabric yarn is looped around another fabric yarn and vice-versa.

The term "coherent" means that the abrasive belt comprises a single, interconnected abrasive area that is continuous—in contrast to isolated abrasive patches or islands. Abrasive area in this context denotes an area with which a work piece can be sanded or abraded. The expression "fabric yarn" refers to the yarns that form the basis of the textile fabric. Preferred textile fabrics are defined in ISO 8388 and comprise weft-knitted jersey-based fabrics, weft-knitted double layer jersey-based fabrics, weft-knitted rib-based fabrics, weft-knitted purl-based fabrics, warp-knitted jersey-based fabrics, warp-knitted double layer jersey-based fabrics, warp-knitted rib-based fabrics, warp-knitted purl-based fabrics, combined warp- and weft-knitted jersey-based fabrics and others. In addition, woven fabrics are conceivable.

Due to the through holes, sanding dust and other particles can easily penetrate through the abrasive belt. This considerably facilitates the removal of dust from the sanding area, where the work piece is machined and prevents the clogging of the abrasive belt. In turn, this increases the lifetime of the abrasive belt and prevents an excessive heating of the sanding surface which ensures a high quality sanding finish. Moreover, the provision of the through holes enables that an operator can look through the abrasive belt when the belt is driven to circulate. This allows the operator to have a better control of the grinding process, which is particularly important for machines in which the sanding pressure is applied manually. Also for automatic sanding machines this feature is advantageous, however, as it allows for a visual quality control during the sanding process.

The coherent abrasive area ensures an even finishing of the sanded product, as, due to the coherent abrasive area, there are no isolated patches throughout the belt that might show up as stripes in the sanded surface. The regular distribution of the openings further contributes to an optimized surface finish on the sanded work piece. On the one hand, a regular distribution of openings means that the area between adjacent openings is substantially constant throughout the abrasive belt, which is equivalent to the notion that also the area density of the abrasive areas is substantially constant throughout the belt. On the other hand, a regular distribution of through holes rules out that there are local variations in the number of through holes, which might lead to an uneven sanding result. In this respect, "area density" is an illustrative term that can be conceived as the local quotient of the area occupied by the abrasives in a certain portion of the belt over the virtual total area of the belt in that portion (i.e. the area including the holes). Naturally, this definition is only sensible if said portion is dimensioned to have a length which is at least twice the long dimension of the openings.

At the same time, the textile fabric being formed of interconnected fabric yarns ensures that the abrasive belt has sufficient mechanical properties that are necessary for abrasive belt applications. In particular, by using a textile fabric being formed of interconnected fabric yarns, through holes can be formed in the belt while the longitudinal elongation can be kept low and a certain strength in the transverse direction can be attained.

This is not only applicable to an abrasive belt but to any grinding product suitable for unidirectional sanding operations in which an abrasive material extends along a vertical or horizontal axis with the objective to create an evenly sanded surface area after the abrasion process. Typically the conversion form of such a grinding product takes the form of a belt, but can also be in the form of rolls, sheets, triangular shapes, discs or other suitable conversion forms.

Preferably, the openings are arranged in lines perpendicular to the machine direction of the belt, wherein the openings are regularly spaced in the line direction and the lines are offset from one another with respect to the position of their openings.

The machine direction is the direction in which the belt is driven to circulate, when used in a sander or the like. If the abrasive product is used in a different conversion form such as a roll, sheet or the like, the machine direction can also be conceived as direction in which the abrasive process is carried out when using the material.

The regular spacing of the openings in the line direction ensures that an even sanding surface is achieved in the width direction of the sanding area. If the lines are offset from one another with respect to the position of their openings, the openings are not arranged in uniform rows along the machine direction. This further diminishes the occurrence of stripes along the width of the sanding area.

Thereby it is further preferred that subsequent lines (i.e. lines that follow one another in the machine direction) are offset from one another with respect to the position of their openings.

In this regard, it is furthermore preferable that the offset between subsequent lines is such that the openings of every second line align in the machine direction.

If seen in the machine direction, the latter means, with other words, that a region coated with abrasives between two adjacent openings in one line is followed by an opening of the next line which is again followed by a region coated with abrasives of the second next line and so forth. Accordingly, this arrangement efficiently suppresses the formation of stripes in the finished product. Moreover, throughout the entire abrasive belt, a constant local abrasive area density is achieved on length scales of the order of two times the long dimension of the openings. This is equivalent with the notion that a highly homogeneous abrasive area is provided which further contributes to an even sanding finish. In addition, also from the viewpoint of the mechanical stability of the belt, the alternating arrangement of the openings contributes to an improved strength in both the longitudinal and the transversal direction of the belt, as the ensuing symmetric structure of the belt can absorb and distribute forces in an optimal manner.

Preferably, the abrasive belt has a uniform thickness.

The uniform thickness may ensure that a contact surface to a work piece is as uniform as possible, if the abrasive belt is pressed onto the work piece. In addition, this enables the direct control of the pressure with which the abrasive belt is applied onto the work piece.

Preferably, the coherent abrasive area on the one side (i.e. the front side) of the textile fabric comprises a coating on the one side of the textile fabric.

The coating provides an even base layer onto which the abrasives can be applied. Thereby, the coating can level out height-irregularities and further promote an even abrasive area. To this end, the coating may be specifically treated ("flattened") before applying the abrasive particles in order to form an even surface. As described in WO 2014/037034, this can be achieved by a specific way of applying the coating, e.g., by using a coating roller. Moreover, a flattening effect can be realized by pressing a flattening device against the not yet cured coating. In addition, there is the possibility of mechanically abrading or sanding the readily applied coating such as to level out (flatten out) any existing unevenness.

The other side of the abrasive belt (i.e. the backside) may be substantially free of the coating. On the one hand, this enables to reduce the amount of coating necessary for manufacturing the abrasive belt and therefore contributes to a more cost-efficient product. On the other hand, since the other side of the textile fabric is substantially free of the coating, the resulting product is more flexible. During use, this may be beneficial especially if the driving rollers around which the abrasive belts are wound have small diameters. It should be noted that "substantially free of coating" does not rule out that the fabric yarns carry other materials which are, for instance, part of an impregnation of the textile fabric.

Alternatively/additionally, the abrasive belt may also comprise a coating which is applied on the other side (i.e. the backside) of textile fabric. In the following, this coating may also be referred to as "second coating". Thereby, the second coating can be used for further tuning the mechanical properties of the belt. In addition, it might be used to provide a flat backside of the belt. For some applications, a flat backside of the belt would further promote an even sanding finish, especially if high sanding pressures are applied or a sanding process is carried out in close proximity of the driving means of the sanding machine. In addition, this decreases the wear of the abrasives in the abrasive area.

In this regard, it is furthermore conceivable that the backside of the belt is flattened. As in the case of the coating on the front side, such a flattening can be achieved by pressing, calendaring or abrading processes. Thereby, such processes may be either applied directly to the textile fabric forming the backside of the belt or to the second coating, if present.

Preferably, the ratio of the volume of the fabric yarns to the volume of the overall product, not including the openings, is 0.1 to 0.9 and even more preferably 0.4 to 0.8.

Within this volume ratio, an abrasive product with good mechanical and topological properties can be realized. On the one hand, the resulting product has a sufficient mechanical strength to withstand tensional forces in grinding applications. On the other hand, with the given volume ratio, it is readily possible to equal out irregularities in the height profiles of the product that stem from interconnection points of the fabric yarns. Further, the product can be manufactured in a cost effective manner.

Preferably, the weight ratio between yarn and the overall product is 0.2 to 0.9.

Also in terms of this weight ratio, a good compromise between mechanical and structural properties can be reached.

As regards the textile fabric, it is preferable that the fabric yarns are interconnected by being knitted, stitched or woven.

These techniques provide one possibility to optimally meet the conflicting requirements of having an open structure with a preferably highly regular pattern of openings and yet, at the same time, a sufficient resistance of the belt/textile fabric against tensile forces. Moreover, these techniques present a cost-effective way of manufacturing the textile fabric.

Preferably, the openings are uniform (in size and shape), which is beneficial for obtaining an even sanding finish.

Preferably, the openings have the form of an equilateral quadrilateral or are of hexagonal shape.

Being of equilateral quadrilateral or of hexagonal shape is equivalent with the notion that the openings are highly symmetric. This is beneficial in terms of the sanding result as the regions between adjacent openings are highly regular throughout the abrasive belt. In addition, these shapes may contribute to an enhanced tensile strength of the belt, as tensile forces may generally be distributed more evenly.

Preferably, the openings have a long dimension (which is, with other words, the longest diameter of the opening across the opening) and a short dimension (which is, with other words, the shortest diameter across the opening), wherein the long dimension extends in the machine direction of the abrasive belt.

This feature, which, with other words, means that the openings are elongated in the machine direction, further contributes to an improved strength of the abrasive belts against elongations along the machine direction. This can be attributed to the elongated geometry of the structure, which is capable of absorbing tensile forces without inducing a lateral contraction.

Preferably, the long dimension of the openings is between 0.3 mm and 20.0 mm.

These dimensions generally offer a good compromise between mechanical strength of the abrasive belt and a sufficient size of the openings such that sanding dust and other particles can easily penetrate through the abrasive belt. Self-speaking, the values may be adapted to the underlying application.

Preferably, the average width of the openings (i.e. the diameter of the openings in a direction perpendicular to the machine direction) is at least 0.3 times the shortest distance separating neighboring openings in a direction perpendicular to the machine direction. More preferably, the average width of the openings (i.e. the diameter of the openings in a direction perpendicular to the machine direction) is at least 0.7 times the shortest distance separating neighboring openings in a direction perpendicular to the machine direction, and, still more preferably, the average width of the openings (i.e. the diameter of the openings in a direction perpendicular to the machine direction) is between 0.8 times to 1.2 times the shortest distance separating neighboring openings in a direction perpendicular to the machine direction.

If, with other words, the width of the openings in a cross-direction (i.e. a direction perpendicular to the machine direction) is of the order of a connection region in cross-direction, the likelihood of stripes occurring in the sanded work piece can be further reduced. This is due to the fact that, with such dimensions, a good overlap of subsequent openings can be achieved in the machine direction, which further reduces the likelihood of stripe formation.

Preferably, the interconnected fabric yarns are arranged in the form of beams of a plurality of interconnected fabric yarns, wherein the beams separate neighboring openings and are arranged in such a way that they extend in a direction intersecting the machine direction.

Beams are, with other words, strands of interconnected fabric yarns. Accordingly, a beam reflects the overall direction of propagation of the interconnected fabric yarns through the textile fabric, in the sense that small local deviations in the direction of the fabric yarns, stemming for instance from turns or loops of fabric yarns around neighboring fabric yarns are not taken into account for the overall direction of propagation. Accordingly, the beams are the regions of the belt which are coated with abrasives and therefore form the basis for the abrasive area. Due to the fact that the beams extend in a direction intersecting the machine direction (meaning that they do not propagate strictly parallel to the machine direction), the likelihood of stripes in the sanded product can be further diminished.

Preferably, the number of fabric yarns crossing at interconnection points of the interconnected fabric yarns is constant throughout the abrasive belt. More preferably the number of fabric yarns crossing at interconnection points of the interconnected fabric yarns is between two and ten.

In this regard, it is noted that, on the one hand, the formation of interconnections of fabric yarns is preferable, in order to produce a coherent and physically stable material. Without interconnecting the fabric yarns, only loose yarn products but no textile fabric would be created. On the other hand, interconnection points (where fabric yarns cross) necessarily entail a local height variation (i.e., a point where fabric yarns are locally enriched). This is potentially disadvantageous for sanding applications, since interconnecting points might show up as stripes in the finished product. If the number of fabric yarns crossing at interconnection points is kept constant, and still more preferable, to its minimum of two yarns throughout the entire abrasive belt, however, the height variations can be kept at a minimum. Accordingly, a highly uniform thickness of the abrasive belt can be achieved, which permits an even sanding finish.

Preferably, the thickness of fabric yarns is 5 to 4,000 dtex and in particular 150 to 900 dtex.

Preferably, the textile fabric has an atlas or cord structure.

Thereby, atlas or cord structures are suited for combining the desired open structure of the abrasive belt with the requirement of having a uniform and coherent abrasive area. In addition, these structures permit the formation of a textile fabric that can, at least to some extent, withstand tensile strain both in longitudinal and transversal directions without elongating too much.

Preferably, the abrasive belt further comprises reinforcing yarns worked into the textile fabric.

With the reinforcing yarns, the mechanical stability of the abrasive belt can be further enhanced. Since these reinforcing yarns are worked into the textile fabric, they affect the evenness of the abrasive area as little as possible.

Preferably, the reinforcing yarns are worked into the textile fabric in the form of a pillar stitch.

Thereby, the pillar stitch provides a possibility of arranging the reinforcing yarns in directions essentially following the machine direction, which specifically enhances the resistance of the belt against tensile forces in the machine direction. Moreover, the pillar stitch is effective as regards achieving a desired mechanical reinforcement without considerably deteriorating the evenness of the abrasive area.

Preferably, the reinforcing yarns have a thickness of 1 to 1/20 times the thickness of the fabric yarns and more preferably a thickness of 1/2 to 1/10 times the thickness of the fabric yarns.

This ensures that the reinforcing yarns will not lead to pronounced elevations in the textile fabric when being worked into the textile fabric. Accordingly, an abrasive belt can be obtained that is mechanically stable and at the same time has a uniform thickness.

Preferably, the reinforcing yarns are worked into or follow the beams of the plurality of interconnected fabric yarns.

This enables that the reinforcing yarns do not intersect the openings, meaning that the provision of the reinforcing yarns does not adversely affect the open structure of the belt. Although being mechanically reinforced, the desired permeability of the abrasive belt for sanding dust and other particles can still be guaranteed.

Preferably, the textile fabric is impregnated with an impregnation, wherein, still more preferably, the textile fabric is tensed when applying and/or curing the impregnation.

With the help of an impregnation, the mechanical stability of the abrasive belt and, in particular, the strength of the belt as regards elongations in the longitudinal and transversal directions with respect to the machine direction can be further improved. Further, if the textile fabric is tensed while applying the impregnation, the openings in the textile fabric can be brought into desired shapes before being fixed by the cured impregnation. This allows tailoring the shape of the openings to the respective application. Moreover, if the textile fabric is tensed in the machine direction before applying the impregnation, this further reduces the elongation of the finished abrasive belt in the machine direction.

Preferably, the total surface area of the openings is 0.1 to 10 times the total surface area of the total coherent abrasive area, still more preferably equal to or greater than the total surface area of the total coherent abrasive area, and even more preferably 1.0 times to 2.2 times the total surface area of the total coherent abrasive area.

With other words this means that it is preferred to have a highly open structure that allows sanding dust to easily penetrate through the abrasive belt. Moreover, this ratio between the areas of the openings and the abrasive area ensures that the area fraction of the abrasive area is evenly distributed over the total surface of the abrasive belt and that there is, in particular, no tendency that certain abrasive regions form stripes if the abrasive belt is driven to circulate. In addition, this facilitates the handling of the abrasive belt during use as an operator of a sanding machine may look through the abrasive belt, which is driven to circulate, in order to control and/or adjust the sanding process.

Preferably, when a force of 100 N per 50 mm width of a sample length of 200 mm is applied, the elongation of the abrasive belt is less than 1% and preferably less than 0.8%.

Furthermore, according to another aspect, an abrasive belt is provided comprising a plurality of openings in the form of through holes, wherein the openings are arranged in lines perpendicular to the machine direction of the abrasive belt, the openings are regularly spaced along the direction of the lines and subsequent lines are offset from one another with respect to the position of their openings.

According to yet another aspect an abrasive belt is provided which comprises a textile fabric being formed of interconnected fabric yarns, a plurality of openings in the form of through holes, an abrasive area on the front side of the textile fabric, and a coating on the backside of the textile fabric.

Preferably, the coating on the backside is flattened.

The features as recited above are not only applicable for an abrasive belt, but, in general, to grinding products, in which the abrasive process is uni-directional (i.e. in which the grinding process is predominately carried out along one direction of the grinding product) and the sanding result has to be as even as possible. Besides belt grinding products, possible conversion forms include rolls, sheets, triangular shapes or discs.

BRIEF DESCRIPTION OF THE DRAWINGS

The invention may be better understood by reference to the following specification disclosed in preferred embodiments thereof and taken in conjunction with the following accompanying drawings.

The description and the accompanying drawings are to be construed by ways of example and not of limitation.

DETAILED DESCRIPTION OF THE PREFERRED EMBODIMENT

In the following, preferred embodiments are described in detail with reference to the drawings.

Figure 1:
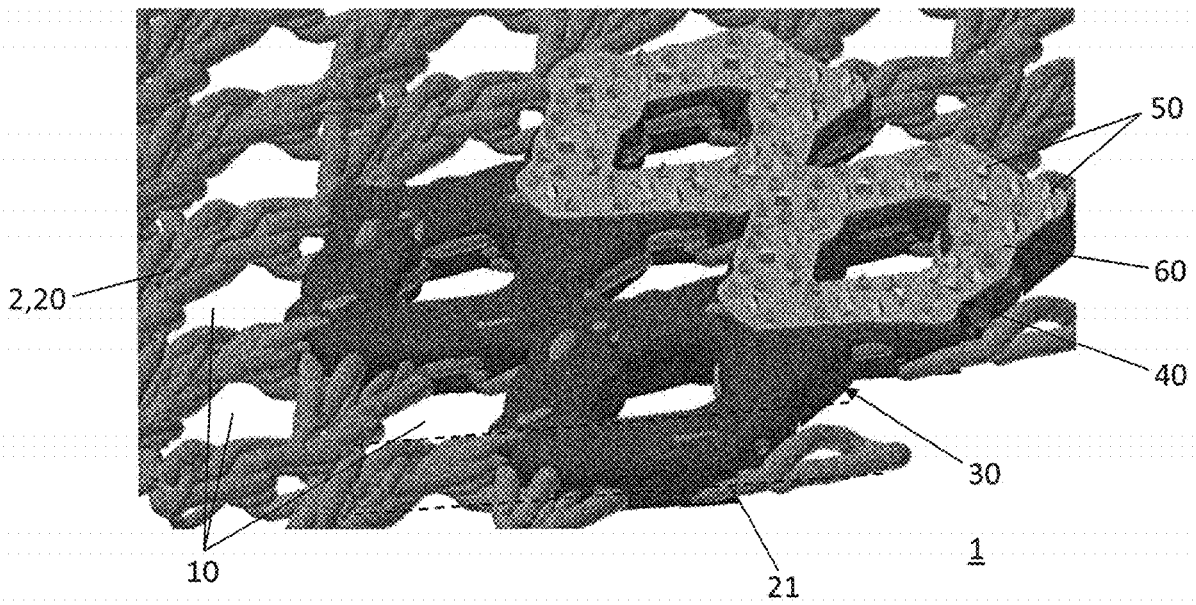
FIG. 1 schematically shows a section of an abrasive belt in different stages of the production process of the abrasive belt according to one embodiment.

FIG. 1 shows a section of an abrasive belt 1 according to an embodiment. The different layers that are shown in FIG. 1 illustrate the abrasive belt 1 in different stages of its manufacturing process. As can be inferred form stage one, the textile fabric 2 of the abrasive belt 1 comprises a plurality of interconnected fabric yarns 20. Preferably, the textile fabric 2 has the form of a knitted textile fabric which can be produced on a textile producing machine by warp-knitting, for instance. In stage two, the textile fabric 2 is physically fixated by applying an impregnation 30. In stage three, the impregnated textile fabric 2 has been coated with a coating 40. Further, abrasive material or abrasives 50 have been applied, optionally by using a suitable binding system. Thereby, a coherent abrasive area 60 is formed, wherein the abrasives 50 are evenly distributed over the abrasive belt 1. Stage three can be referred to as the final precursor stage before further conversions and process stages are carried out to convert the material into a functional abrasive product. It is to be noted that the impregnation is not mandatory and that the impregnation step may also be omitted. In addition the abrasives may directly be applied onto the textile fabric or the impregnation, i.e., without any coating.

The type of interconnection between the fabric yarns 20 is, in general, of minor relevance as long as the conflicting requirements as identified for abrasive belts can be fulfilled: combing a small elongation under load with an open structure and the ability to achieve an even sanding result.

Figure 2:
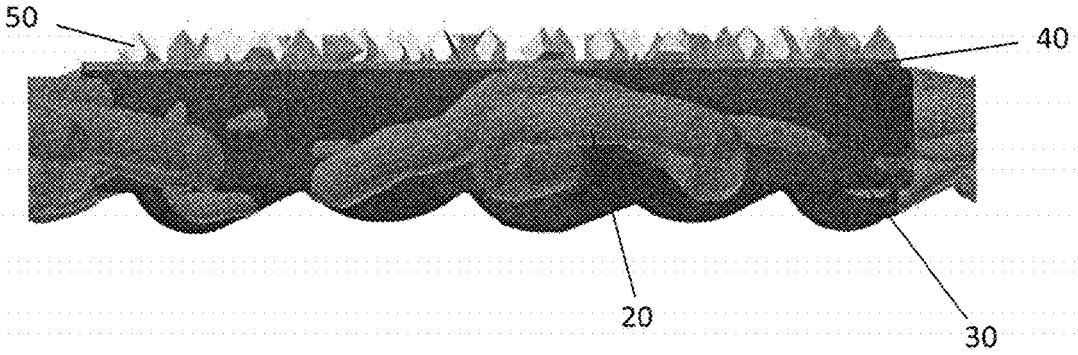
FIG. 2 schematically shows a cross section of the abrasive belt according to a preferred embodiment.

To this end, as can be inferred from the cross-sectional view in FIG. 2, the number of crossings of the fabric yarns 20 at interconnecting points of the fabric yarns 20 is preferably uniform throughout the textile fabric 2. Specifically, in FIG. 2, the number of crossings of the fabric yarns 20 at interconnection points is two.

This ensures that the local enrichment of the yarns 20 due to the interconnections is limited. "Enrichment of the yarns" refers to the fact that in the textile fabric 2, an interconnection of the fabric yarns 20 is necessary in order to produce a coherent and physically stable material. Without interconnecting stitches only loose fabric yarns 20 would be produced but no textile fabric 2 would be created. In theory and in practical terms, a warp knitted or other type of textile needs a minimum of one point of interconnection per stitch. When, however, more than two fabric yarns 20 are crossing at such an interconnection point, more than the minimum amount of fabric yarns 20 for creating such an interconnection point is present. Such yarn crossings involving more than two fabric yarns 20 per interconnection point thus lead to minor elevations in the textile fabric 2 when the level of the interconnection points is compared with the other parts of the textile fabric 2.

The uniform number of crossings throughout the textile fabric 2 ensures a uniform height of the abrasive belt 1 that is preferably of the order of 1.5 to 5 times the diameter of the individual fabric yarns 20. It is also not desired that certain surface areas are on a lower level than other surfaces as this would result in uneven sanding results and the formation of stripes on the sanded surfaces.

Figure 3A:
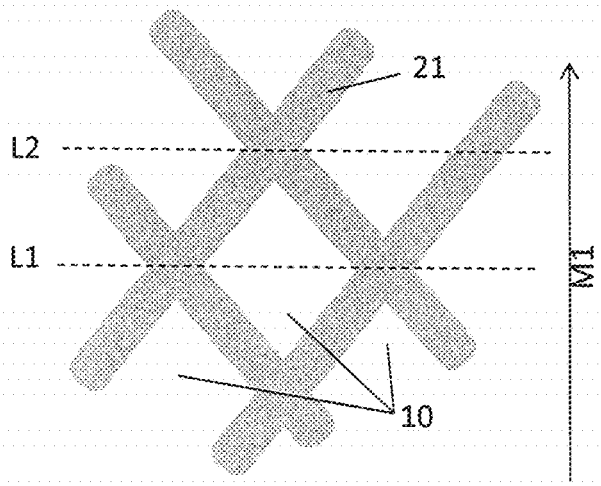
FIGS. 3A and 3B schematically show the silhouette of the structure of the abrasive belt in a top view according to preferred embodiments.
Figure 3B:
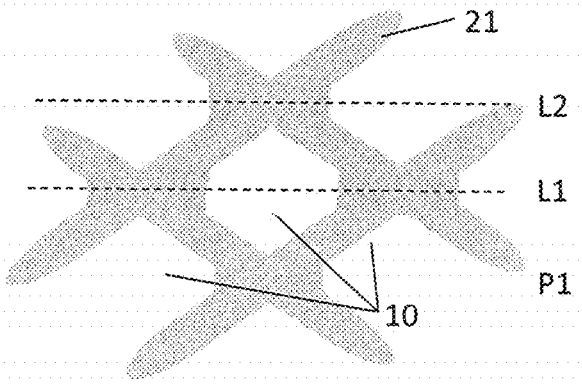

FIGS. 3A and 3B schematically show the silhouette of the structure of the abrasive belt in a top view. The silhouette of the belt 1 is thereby essentially identical to the abrasive area 60. As can be taken from this illustration, the openings 10 are highly symmetric with respect to the machine direction M1 and perpendicular thereto. This is preferable, as such structures ensure that the abrasive regions between adjacent openings 10 are as uniform as possible, which in turn leads to a regularly and evenly distributed abrasive area 60 throughout the belt 1. With other words this means that the local density of the abrasive area, which may be measured in abrasive area per unit area, is essentially constant throughout the abrasive belt 1 (at least on length scales of said unit area, which are larger than or equal to two opening diameters).

Moreover, the openings 10 are arranged in lines L1, L2 perpendicular to the machine direction M1 of the abrasive belt 1 and subsequent lines L1, L2 are offset form one another with respect to the position of their openings 10.

Further, the width of the openings and the width of the region between two openings (i.e. the "connection region") are of the same order in cross-direction (i.e. in a direction perpendicular in the machine direction), which further promotes an even sanding finish. For instance, if the width of the openings is 1.5 mm, the width of the connection region may be 0.3 mm to 5.0 mm, which still guarantees a sufficient "overlap" of the openings of subsequent rows. Even more preferable would be a width of the connection region may between 1 mm to 2.0 mm for a width of the openings of 1.5 mm.

Strands or beams 21 of interconnected fabric yarns 20, which separate neighboring openings 10, run at a given angle with respect to the machine direction M1. The term "beams" of yarns shall refer to the overall shape or direction which is described by the fabric yarns when they proceed in the textile fabric. Accordingly, the beams 21 of fabric yarns 20 will form mirror images of each other seen from a plane crossing the connection points in the longitudinal direction of the belt 1 (FIG. 3). Examples for suchlike geometries of the openings are presented in FIGS. 3A and 3B, wherein FIG. 3A shows essentially equilateral quadrilateral openings 10 and FIG. 3B shows essentially hexagonal openings 10.

The evenness of the abrasive area 60 for the symmetric openings 10 that are illustrated in FIGS. 3A and 3B can be further exemplified by a virtual projection of the abrasive area of two consecutive lines of openings 10 on a line perpendicular to the machine direction, which will be in both cases highly uniform and entail a good "sanding area balance". Thus, the sanding area balance might be seen as a measure for deviations in the physical area of the abrasive area within in one repetition of the pattern, i.e. within two consecutive lines L1, L2.

In this regard, the equilateral openings 10 may provide a sanding area balance that is even better as in the case of the hexagonal openings 10 if the machine direction is as indicated in FIGS. 3A and 3B. Interconnection points between the single hexagonal openings 10 shall in that case be kept as short as possible as such areas will disrupt the sanding area balance between the areas coated with abrasives 50.

As regards the beams 21, the number of fabric yarns 20 per beam 21 is preferably two as this ensures a uniform thickness of the belt 1.

Figure 4:
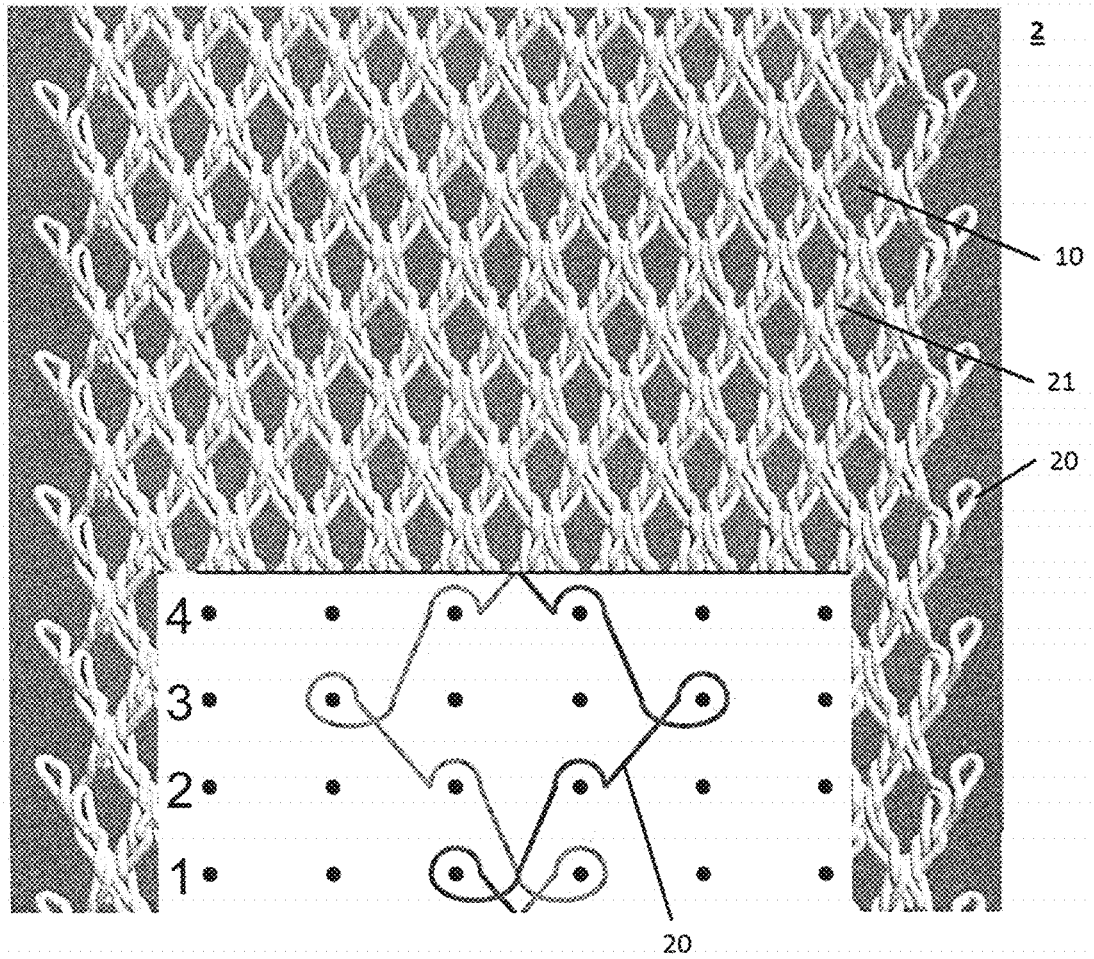
FIG. 4 shows an example of a knitting pattern according to a preferred embodiment.
Figure 5:
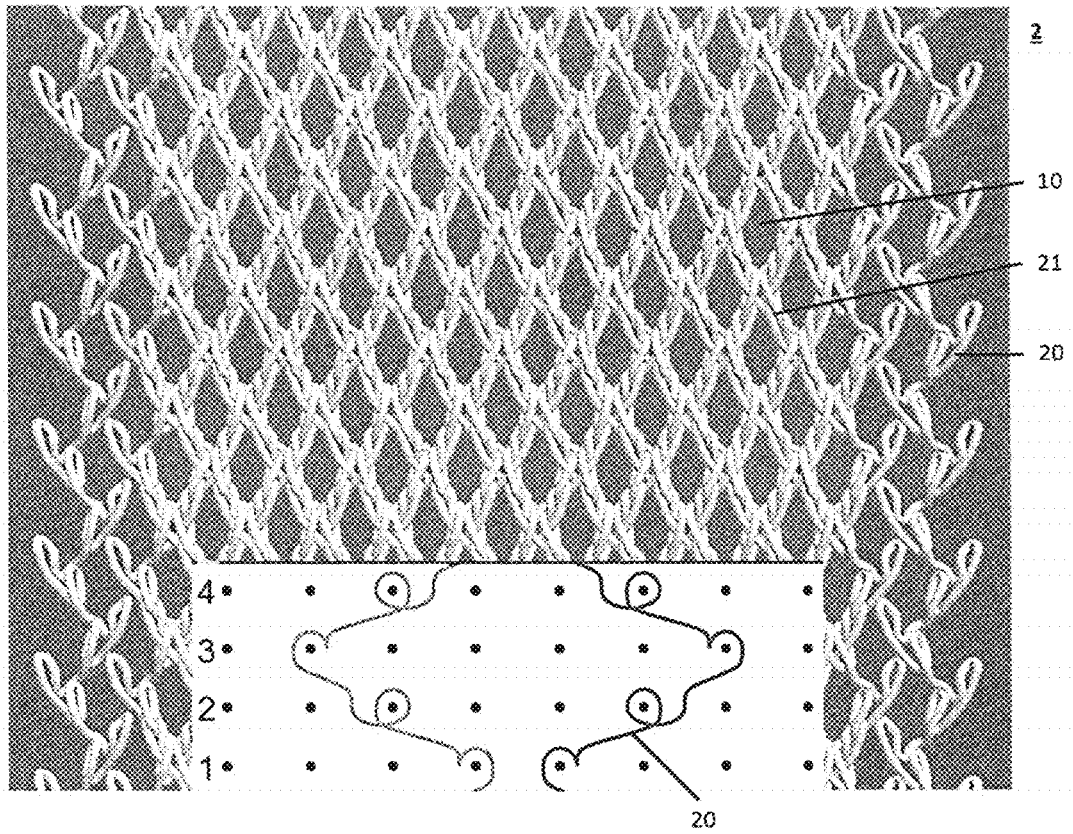
FIG. 5 shows another example of a knitting pattern according to a preferred embodiment.
Figure 6:
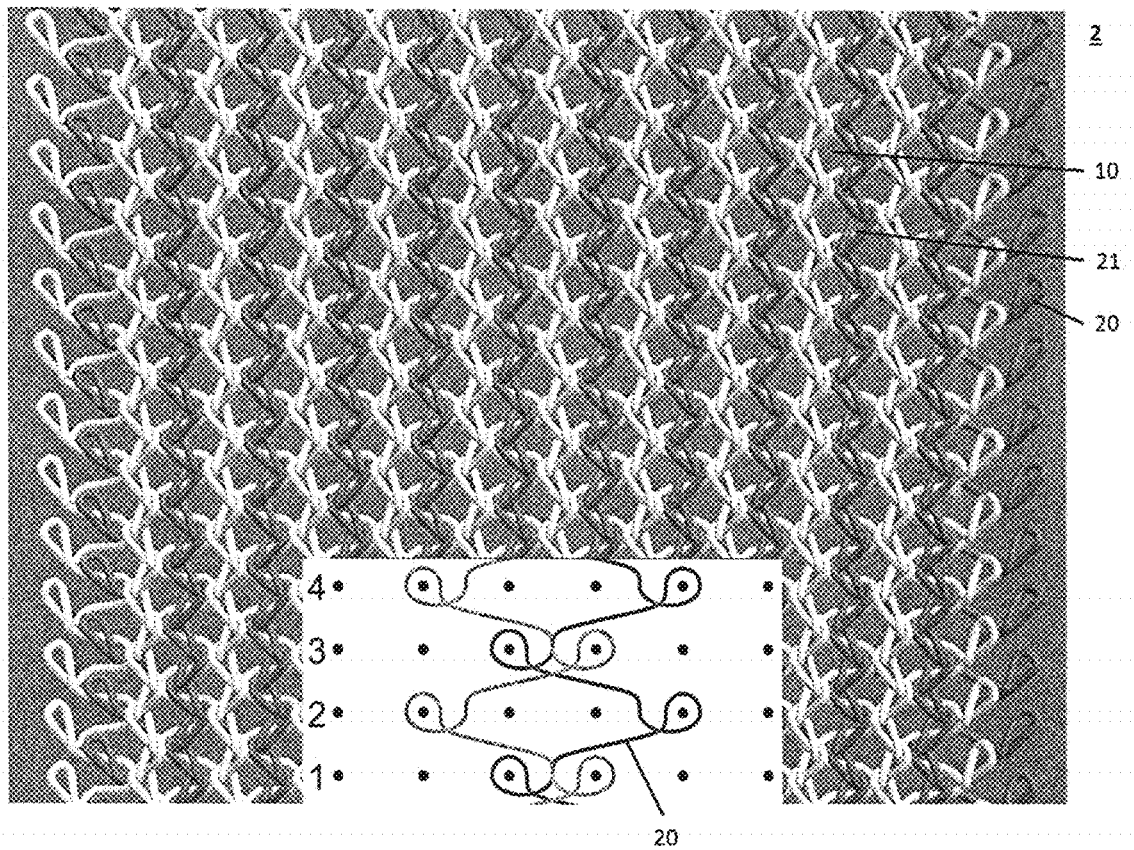
FIG. 6 shows another example of a knitting pattern according to a preferred embodiment.

If the textile fabric is formed of knitted yarns, preferred knitting patterns are shown in FIGS. 4 and 5. Another preferred knitting pattern is illustrated in FIG. 6.

Turning first to FIGS. 4 and 5, one possible structure is based on a textile fabric with open (FIG. 4) or closed atlas binding (FIG. 5).

The term "open atlas binding" refers to a knitting pattern on a warp-knitting machine which proceeds over two or more rows. Hereby, the intermediate stitches between the stitches which induce a directional change can either be open, closed or a combination thereof. An open stitch pattern is for instance based on the following warp-knitting structure type: 1-0/1-2/2-3/2-1// (FIG. 4). Thereby the notation 1-0/1-2/2-3/2-1// is the notation according to the ISO 8388: 1998-standard (page 76, "B4 Chain Notation").

The term "closed atlas binding" refers as well to the intermediate stitches between the directional changes in the knitting pattern. In contrast to the example of the open atlas binding, a closed atlas binding follows for instance the following knitting structure type: 0-1/2-1/3-2/1-2// (FIG. 5).

In case of an atlas binding, the beams 21 of interconnected yarns 20 generally may be seen as obliquely protruding with respect to the machine direction M1 of the belt 1.

Preferably, a two-row atlas structure is used. In this regard, the number of rows refers to the number of stitches which proceed into one direction before the knitting proceeds into the opposite direction. Another definition is by referring to the repeat height of the pattern. In this case the number of rows equals half of the repeat height. For instance, in case of an atlas repeat height of four, the number of rows consequently equals two. In this context, the term "course" may be used which, in the field of warp knitting, refers to the number of stitches needed until the pattern which is to be knitted begins to repeat itself. Consequently a pattern having a repeat height of four requires four courses until the next repeat begins.

Structures based on two rows provide openings 10 which are equilateral quadrilateral. Accordingly, all the surfaces located in between the openings 10 in the textile fabric 2 have exactly the same area. This ensures an even distribution of the abrasive area throughout the abrasive belt 1. At the same time, the enrichment of the fabric yarns 20 at the interconnecting points can be kept low. Moreover, the openings 10 are arranged in lines L1, L2 perpendicular to the machine direction M1 of the abrasive belt 1 and subsequent lines are offset form one another with respect to the position of their openings 10. Therefore, when used as an abrasive belt 1, such structures will provide an equal rate of removal throughout the entire sanding surface. In turn, the formation of stripes or similar structures on the work piece can be avoided.

Moreover, the openings 10 are elongated in the machine direction M1, which is beneficial for the general resistance of the textile fabric against elongation in the machine direction M1.

Preferably, the binding direction is alternating for every needle. The binding proceeds in the same direction in each second needle in this structure, and it is also possible to use an atlas filet binding with more than two rows, like for instance three, four or more rows, but these structures are more prone to induce stripes on the work piece.

As mentioned, another example for a preferred knitting pattern is the cord stitch as shown in FIG. 6. Thereby, the cord stitch may form a net structure with similar quadrilateral openings 10 as in the previously mentioned two row atlas structure (c.f. FIG. 6).

Such a structure would follow a lapping pattern of e.g. the type 1-0/2-3// (FIG. 6). Also this pattern will result in a structure possessing a low enrichment of yarns in the interconnection points, such as the previously described atlas binding.

Structures with low enrichment of fabric yarns 20 as the ones that are shown in FIGS. 4 to 6 will as such allow the fabric yarns 20 to be as much as possible on a similar height level on both the front and backside of the textile fabric 2, which is preferable for many applications of the abrasive belts. In this case, the front side of the textile fabric 2 will carry the abrasive materials 50 and the back side of the textile fabric 2 will bear and distribute the pressure from the backing device as evenly as possible.

Also for the cord stitch, the openings 10 are highly symmetric and the abrasive areas between adjacent openings are highly uniform throughout the abrasive belt 1. Moreover, adjacent openings 10 are offset with respect to one another in the machine direction M1 of the belt 1. This will ensure a sanding result which does not cause stripes on the sanded article.

Figure 7:
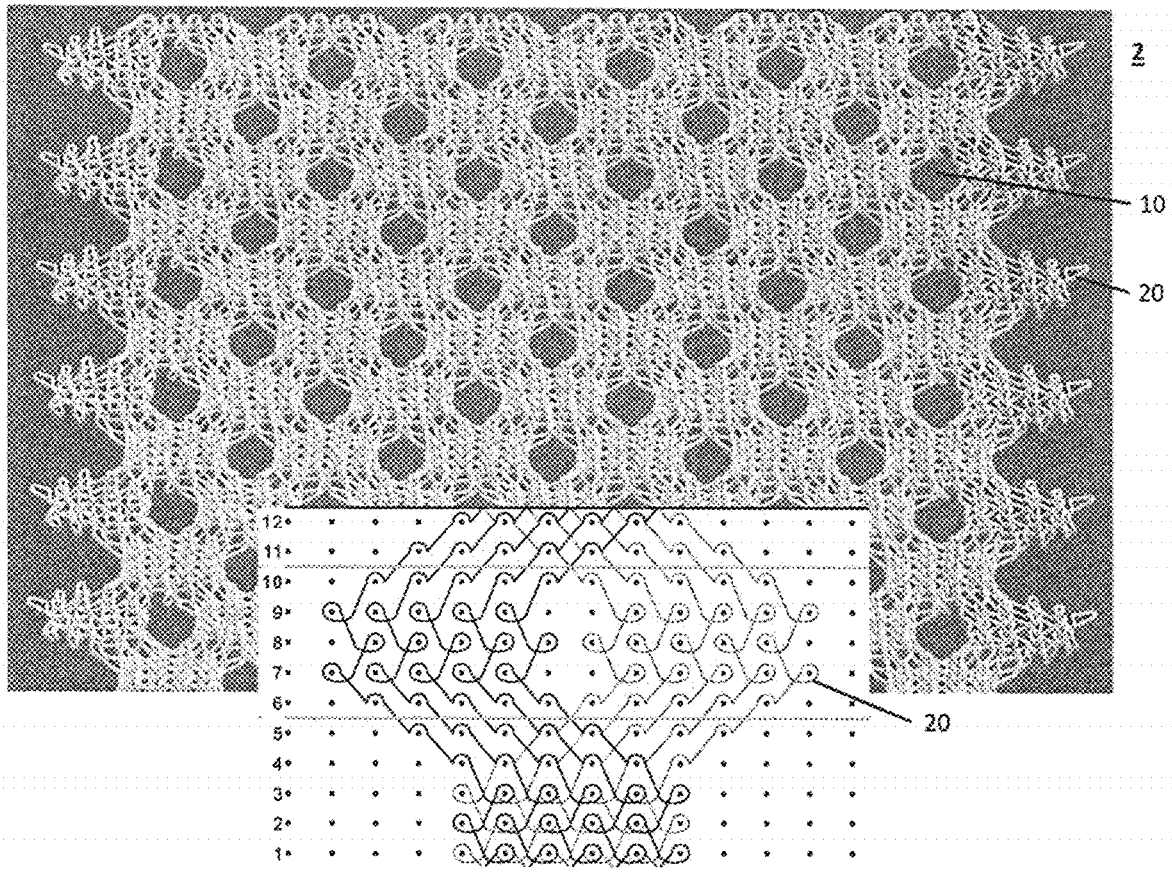
FIG. 7 shows another example of a knitting pattern according to another embodiment.

Although with the atlas binding and the cord stitch two preferred knitting patterns have been described, it should be noted that the present invention is not limited to these structures. Other knitting patterns might also be suited for achieving the desired properties in terms of mechanical stability, permeability of the belt for dust and other particles and an even sanding result. One additional example is shown in FIG. 7, in which a warp knitting structure of the type 10/12/10/12/23/34/45/43/45/43/32/21// is shown. Accordingly, a more closed product with less dust extraction capability but very high mechanical strength in machine direction results. However, the sanding result might be more uneven as compared to the aforementioned structures.

Textile fabrics which are in principle suitable are defined in ISO 8388 and comprise weft-knitted jersey-based fabrics, weft-knitted double layer jersey-based fabrics, weft-knitted rib-based fabrics, weft-knitted purl-based fabrics, warp-knitted jersey-based fabrics, warp-knitted double layer jersey-based fabrics, warp-knitted rib-based fabrics, warp-knitted purl-based fabrics, combined warp- and weft-knitted jersey-based fabrics and others.

It is also conceivable to transfer the patterns and shapes of the openings to other base materials, like woven textile fabrics or even paper-backings and films. Moreover, it is also possible to manufacture structures with various threadings to achieve different opening sizes and surface area ratios between openings and abrasive areas.

In order to further promote the mechanical stability and, in particular, the resistance of the textile fabric 2 against an elongation in the machine direction when tensed, it is preferable to integrate a reinforcing inlay or generally reinforcements into the belt 1. Preferably, these inlays consist of reinforcing yarns 25 that are worked into the structure of the belt 1.

Figure 8:
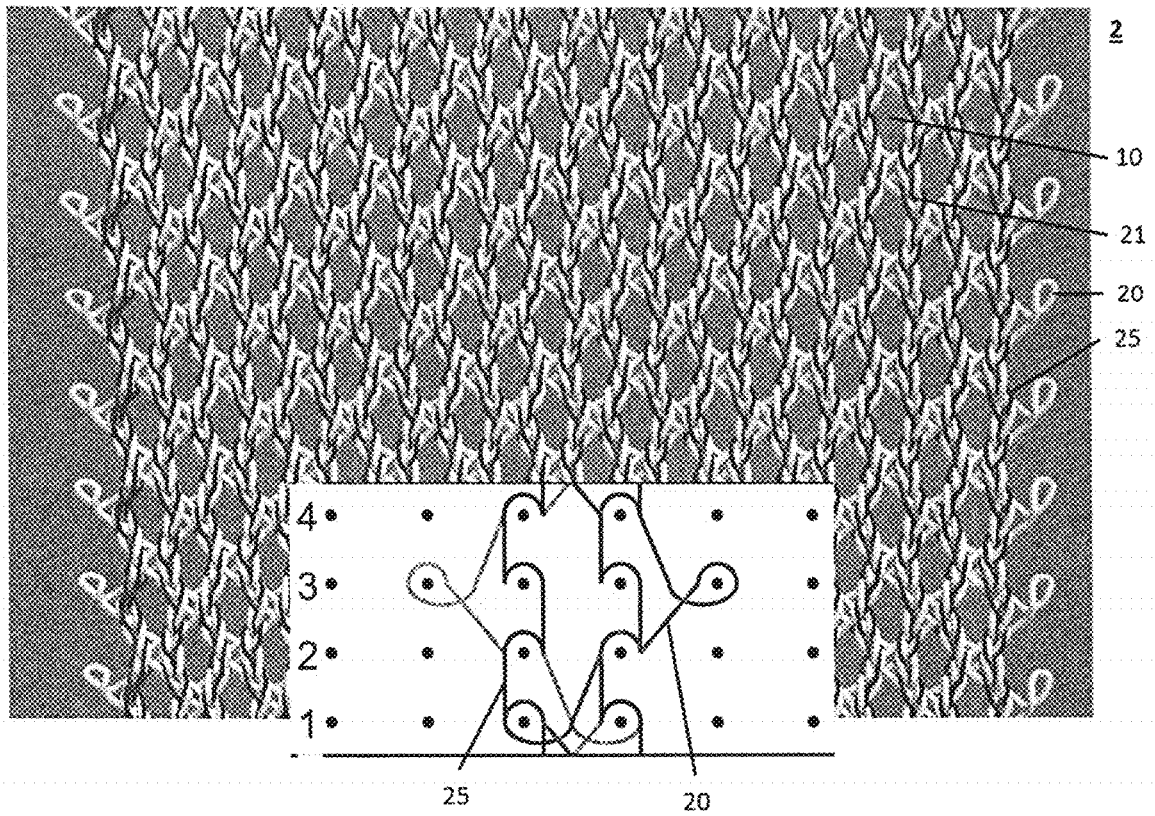
FIG. 8 shows an example of a reinforced knitting pattern according to a preferred embodiment.

Preferably, a pillar stitch or an inlay can be integrated as reinforcements in the machine direction. FIG. 8 shows an example of a possible knitting structure that is reinforced by reinforcing yarns 25. Thereby, the reinforcing yarns 25 are shown in dark color. By way of example, the reinforcement yarns 25 shown in FIG. 8 are worked into a two row atlas binding. The resulting structure possesses predominantly quadrilateral openings with minimal yarn enrichment in the connection points. The use of a pillar stitch for longitudinal reinforcement of the textile fabric leads to an additional enrichment of yarn in this specific structure.

A preferred integration of an inlay of reinforcing yarns 25 into an atlas structure consists of the use of an open or closed pillar stitch proceeding over two rows as shown in FIG. 8. In such a configuration, the reinforcing pillar stitch of the type 1-0/0-1// or 0-1/1-0// will protrude along the general direction of the atlas binding and, therefore, will not lead to a partial coverage of the openings. With other words, the reinforcing yarns generally follow the beams of the interconnected fabric yarns. Such reinforcement is also worked into the basic binding by stitches in the way that it is mechanically bound by stitches to the base textile fabric and thus only allows a certain, limited stretchability (FIG. 8).

Figure 9:
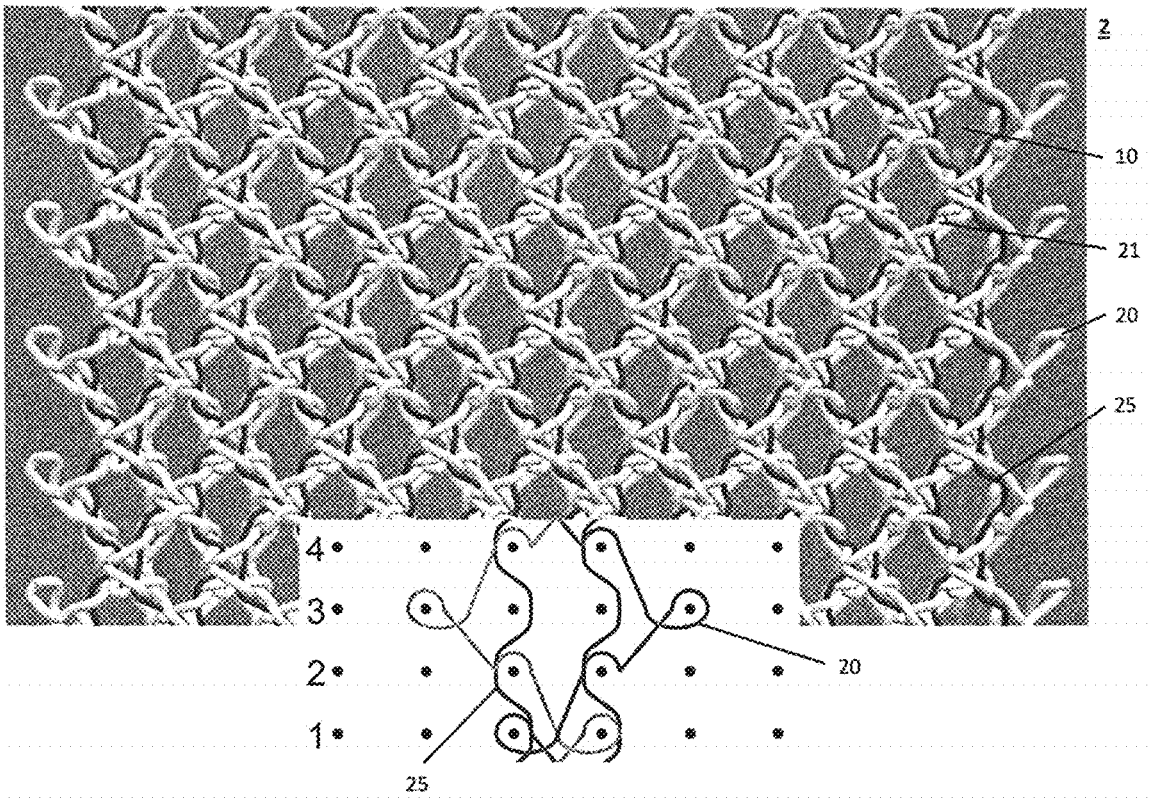
FIG. 9 shows an example of a reinforced knitting pattern according to a preferred embodiment.

Self-speaking the above atlas structure may also be reinforced in various different ways in order to reduce its elongation along the knitting direction of the textile fabric 2. One other example is shown in FIG. 9, in which the atlas binding of FIG. 4 is reinforced by an inlay binding of 0-0/1-1//. In addition, in an atlas structure with a two rows net structure, open or closed stitches plus inlay 0-0/0-0// are also suited to reduce the elongation along the knitting direction of the textile fabric. However, such a reinforcement type might lead to partial coverage of the openings in the textile. Another type of reinforcement is the incorporation of an inlay of the type 1-1/1-0 which will follow the structure of the atlas binding more closely.

Figure 10:
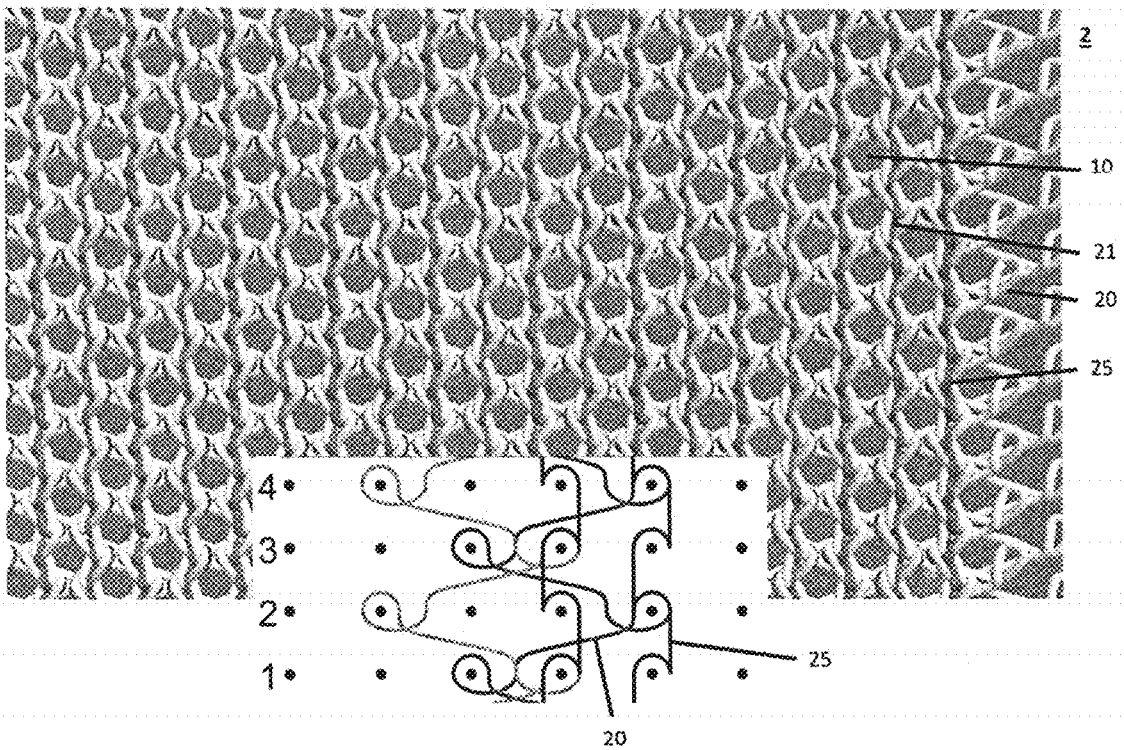
FIG. 10 shows another example of a reinforced knitting pattern according to a preferred embodiment.

Also for the cord binding, it is possible to integrate a pillar stitch in order to improve the mechanical properties of the material. An example is shown in FIG. 10, in which a pillar stitch of the type 1-0/0-1// or 0-1/1-0// is applied.

An alternative to using a pillar stitch is to use an inlay yarn which protrudes along the machine direction through the material and leads to a similar reinforcement as the previously described pillar stitch reinforcement.

Noteworthy, yarns which are either inserted as an inlay, a warp yarn or as a knitted pillar stitch lead to very low values of mechanical displacement when longitudinal forces are applied. The structure as described is nonetheless prone to stretch in transverse direction. This circumstance can be utilized for controlling the size and shape of the openings 10 in the textile fabric 2 during the impregnation process by stretching the textile fabric 2 and allowing the formation of larger or smaller openings 10 in the material.

The inserted knitting structure, inlay-yarns or reinforcing yarns 25 need to be sufficiently thin in order to avoid the creation of height differences in the final textile fabric surface and, at the same time, sufficiently strong to withstand tensile forces.

Preferably, the reinforcing yarns 25 have a maximum thickness of approximately 0.05-2.00 mm More preferably, the thickness is in the range of 0.1-0.5 mm. In relation to the thickness of the fabric yarn 20 of the base textile fabric 2, a thickness ratio of base fabric yarn to reinforcing yarn of approximately 1:1 to 20:1 is applicable wherein a range of 7 10:1 to 2:1 is in most cases preferred. With such a thickness for the reinforcing yarns 25, it can be ensured that the uniform height distribution of the textile fabric 2 is not too much affected by the integration of the reinforcing yarns 25.

In this context, it should be noted that small height differences might be re-balanced in a later process step. This may include that, for instance during coating of the abrasive articles, printing technologies maybe applicable such as screen print, ink-jet, gravure roller coating and the like, in order to apply a coating in a fashion which enables the abrasive articles 50 to be strewn in such a manner that these only occupy a defined area of the textile fabric. In addition, the coated surface may be machined by an abrading or sanding process in order to obtain an even surface finish. In such a way, an inequality in sanding area balance of the impregnated textile fabric structure can be compensated during the coating process.

The same applies for a facultative second coating (not shown) that is applied on the backside of the belt. Accordingly, the second coating can be used for leveling the "backside" of the belt (i.e. the side that does not come into contact with the work piece).

The fabric yarns 20 for the base textile fabric 2 of the abrasive belts 1 as well as the reinforcement yarns 25 are typically texturized or flat yarns of polyester or polyamide due to their suitable tensile properties and low costs. However, yarns based on natural fiber such as cotton, hemp or similar fiber may also be suitable. This includes in more general terms the use of so called staple fiber or multifilament yarns based on synthetic or natural fibers which can be used for the base structure or the reinforcement of the textile fabric. Twisted yarns being single or plied yarns can optionally also be used. Elastic yarns may be applicable in certain applications when the textile fabric shall be stretched in a specific way, e.g., when a change in shape of the openings into a special shape is desired.

The term "texturized yarn", commonly known as DTY (Drawn Texturized Yarn), is a multifilament yarn which has been treated by thermal or mechanical methods or combinations thereof in a way that the yarn filaments are coiled, crimped or looped. There are various texturizing methods which can be applied, such as air texturized, knife edge texturizing, false twist friction texturizing, stuffer box texturizing or gear crimped yarn.

The term "flat yarn" is commonly known under the abbreviation FDY, which is so called Fully Drawn Yarn. Such FDY's can be of various buildup types based on mono- or multifilament. These yarns can also be either bright, semi dull or full dull in respect to their appearance, which are the most common types. However also various shapes of yarns, filaments and their cross sections are available which amongst others can be for instance of the type round, trilobal, multi-edged or of any other type of shape.

Yarns of either type, such as texturized or flat yarn, can apart from their type of texturization, or shape and appearance additionally also be twisted. "Twisting" refers to turning the yarn into two different directions which are commonly referred to as "S" and "Z" directions. These directions of twist only refer to the direction in which the yarns are twisted; so that "S" and "Z" twisted yarns resemble mirror images of each other. Such twisting of yarn has in most cases barely any technical relevance in warp knitting, but leads to different optical effects in the final textile fabric.

The fabric yarn 20 for the base textile fabric 2 as well as the reinforcing yarns 25 may be monofilament or multifilament yarns.

The term "monofilament yarn" refers to a man-made, endless spun yarn which is built up of a single filament of material. A yarn of a certain thickness as e.g. 20 dtex is not separated into other substructures but consists of only one filament. A multifilament yarn consequently consists of several substructures (filaments) in contrast to a monofilament yarn. Hereby, yarns can be distinguished by the number of filaments that the yarn consists of. As an example, a 20 dtex multifilament yarn can consist of for instance two or more filaments.

A "plied yarn" typically consists of multifilament yarns, which can be twisted or non-twisted yarns, texturized or non-texturized yarns, as well as intermingled or non-intermingled yarns. Whereas typically twisted yarns are not intermingled. These previously described single yarns can then in the following be joined together to form a new, thicker, yarn which is referred to as being plied. Such a plied yarn consequently consists of at least two or more single yarns which have been plied together.

The term "natural fibers" refers to fibers which have an origin in renewable sources. These refer to fiber formed materials such as cotton, hemp, wool, silk or similar materials which are directly obtained from plants or animals.

The term "man-made fiber" is referring to all other fibers than natural fibers. Man-made fibers can be synthetically produced from petrochemicals, bio-based polymers or organic raw materials. Regenerated fibers are one subgroup under man-made fibers. Those are made of natural materials like plants by going through chemical and mechanical process. These kinds of fibers are e.g. Viscose, Bamboo and Modal type yarns which are made of cellulose. Synthetic fibers can be made of petrochemicals e.g. polyester, vinyl acetate, nylon, aramid and carbon. This category also includes chemically modified fiber formed materials and fibers manufactured from polymers of bio-based building blocks like for instance, lactic acid, amino acids or propylene dioxide based materials.

Another important property of an abrasive belt 1 may be the electrical conductivity of the final abrasive product which may include the incorporation of carbon fibers or yarns of similar materials which provide conductive properties. Examples of such modified yarns are metal-coated yarns or yarns which have a conductive core or are treated with other treatments.

This does not exclude that the base textile fabric 2 even may solely be composed of carbon or other conductive yarns. In order to achieve a highly conductive material, this naturally shall also apply in regard of the resin used for impregnation of the textile fabric. The resin may also contain conductive elements such as carbon, metals, metal ions and the like, in order to achieve conductive properties of the composite of textile base and resin impregnation.

Examples of other potential yarns for textile based belts include fibers of ultrahigh molecular weight polyethylene (UHMWPE), polypropylene (PP) and aramid yarns. These can be used for the base structure of the textile fabric or solely for the reinforcement of the material.

The thickness of flat or texturized yarn may range from 5 to 4000 dtex, depending on the desired tensile and elongation values of the textile fabric as backing material, as well as the desired size of the abrasive grains or the end use of the final product. The unit "dtex" is by definition the weight in grams per 10,000 m of yarn. A typical thickness for the atlas base yarn is between 150 to 900 dtex and between 15 to 450 dtex for the reinforcing yarns.

When a knitted structure—even if reinforced by reinforcing yarns—is exposed to forces in the longitudinal direction, this may result in a small but still undesired elongation. This can be avoided if the textile fabric 2 is already exposed to longitudinal stretching at the time when the material is impregnated with a resin or coated with the coating or the second coating prior to the application of the abrasives. Due to this stretching of the textile fabric during impregnation, the mechanically displaceable parts are set under tension. By consequence, the yarns are still under strain when the impregnation 30/coating 40 is cured and the textile fabric 2 can withstand longitudinal forces better and further stretching is reduced.

Additionally, it is possible to control the stretchability of the textile fabric 2 in a transverse direction after final curing of the impregnation 30. Hereby, a more extensive stretching of the textile fabric 2 will lead to the formation of larger openings 10 but will also reduce the transverse elongation of the impregnated material after curing is complete. Such a more extensive stretching during impregnation prevents the final textile fabric 2 from stretching excessively in the transverse direction when the material is used as an abrasive belt, as during its use also transverse forces may occur (though the forces in transverse direction are typically of significantly lower magnitude than the forces occurring in longitudinal direction).

Different types of impregnations 30 and coatings 40 may be applied for the textile fabric 2. The same applies for the second coating on the backside of the belt. The types of resins used for impregnations and coatings may consist of phenolic, urea or latex as well as blends thereof as described in EP 0 779 851. The belt may be coated by using roller coating, spray coating, curtain coating, by printing methods such as screen printing or gravure rollers, transfer foil or similar methods resulting in coatings referred to as a make- and size-coat. Further on, also radiation curable impregnation resins such as epoxides, acrylates, or similar resins may also be applied. Also thermally curable epoxies, acrylates, isocyanides or similar resins and mixtures thereof may be utilized for the mechanical stabilization of the textile fabric. The resins may include fillers and additives such as surface active substances like fatty acid ethoxylates, fillers or various kinds such as fibers, aluminum trihydroxide, kaolin, calcium carbonates, talc and the like.

The textile fabric 2 of the belt 1 may furthermore be subject to any kind of surface modifications from either technical front- or backside of the textile like also described in EP 0 779 851.

The abrasive areas 60 may in the same or separate processes be strewn or coated with abrasive articles 50 such as silicon carbide, aluminum oxide of various types or mixtures thereof such as brown, pink, white, or high temperature treated species. Hereby also high performance abrasives such as ceramic coated or similar grains as well as diamonds, CBN or other particles commonly referred to as super-abrasives can be applied.

Figure 11A:
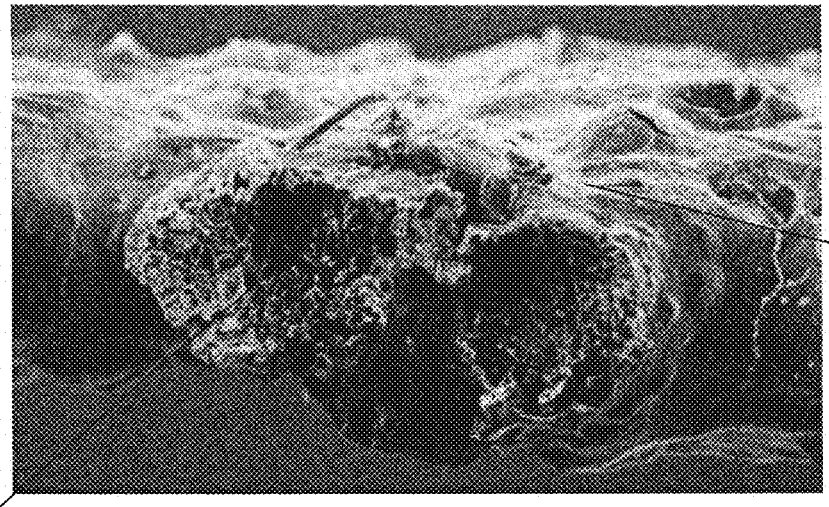
FIGS. 11A to 11C show SEM-images of cuts through grinding products.
Figure 11B:
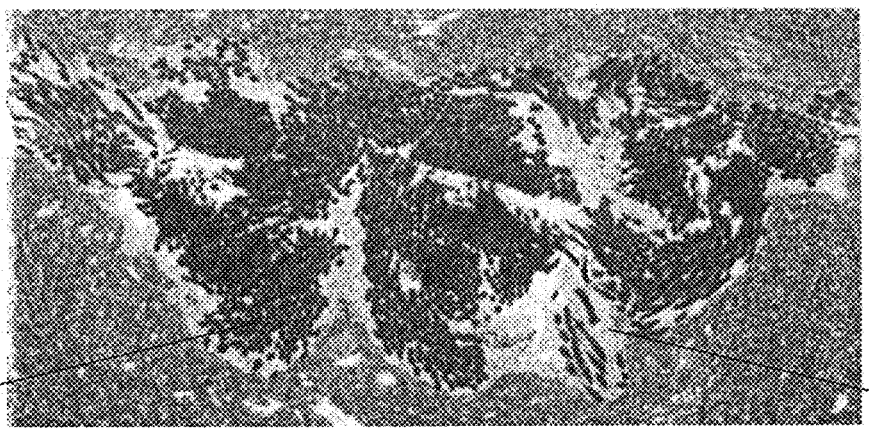
Figure 11C:
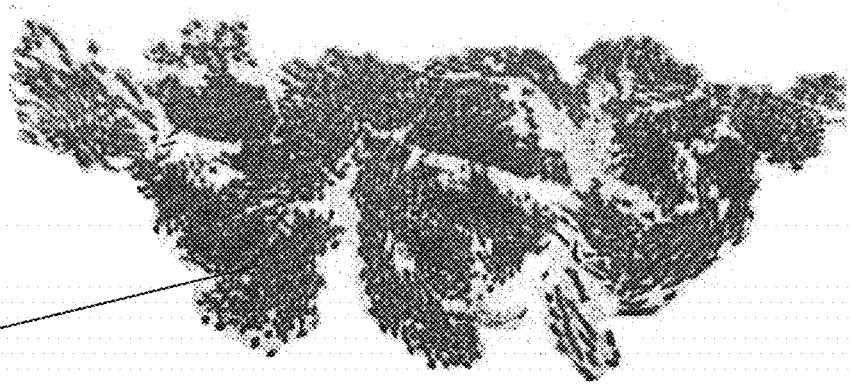

FIGS. 11A, 11B, and 11C show SEM-images of a cut through the cross section of the impregnated fabric. The cut runs perpendicular to the previously defined machine direction of the fabric and at the same time perpendicularly to the front and back sides.

In the original SEM-images (FIGS. 11A and 11B) the fabric yarns can easily be distinguished from the surrounding impregnation resin. FIG. 11B shows a cross cut section which was embedded into a "mold resin" (which is unrelated to the actual product and merely applied for imaging purposes) prior to cutting in order to achieve a planar cut and have the possibility to determine the area ratio between fabric yarns and surrounding impregnation resin by photographical analysis methods. The surrounding area of the mold resin is hereby taken into account and reduced from the total cross-section area.

In order to calculate the volume fraction ratio of the yarns and impregnation resin the same analysis is performed on several repeated cuts (>5) in the machine direction in order to obtain a statistically relevant result.

The fibers are identified either manually or by means of an image recognition algorithm and the associated number of pixels is extracted (FIG. 11C). The image for extracting the number of pixels of the yarn area is shown in FIG. 11C. A similar colored or color inverted picture is used to determine the area of pixels covered by the impregnation resin. The number of pixels from the yarn surface is then related to the total number of pixels of the cut surface of the product or the number of pixels of the impregnation resin.

By calculating the average area fraction of the fabric yarns in relation to the average fraction of the impregnation resin for a statistically sufficient number of cuts this can be taken as a volume ratio between the yarn and impregnation resin. In the example that is shown in the FIGS. 11A to 11C, the volume fraction of fabric yarns to impregnation resin amounts to about 1.7 and, correspondingly, the volume fraction of fabric yarns to the total volume of the product (excluding the openings) is about 0.6.

It is also possible to determine the weight fraction ratio of the fabric and the impregnated fabric by relating the weight of the fabric and the impregnated fabric after curing. This ratio lies between 0.05 and 0.9, whereas it preferably lies between 0.1 and 0.7 and even more preferably between 0.2 and 0.4. An abrasive belt with sufficient mechanical properties can be formed within these ratios.

At the same time, a certain amount of resin ensures that the irregularities stemming from the textile fabric backing (in terms of enrichment points of the fabric yarns) can be balanced out.

Although, in the above example, a sample has been investigated in which only impregnation resin is present, the above analysis can equally well be applied for products that are (additionally) coated. In that case the values are corresponding volume/weight ratios of fabric yarn to resin wherein the resin fraction is then either formed by impregnation resin plus coating or merely coating.

In even more general terms, if additional components are present, the above analysis will lead to volume/weight ratios of the fabric yarns to the volume/weight of the overall product (not including the openings) and/or to the applied coatings and combinations thereof.

The requirements for abrasive belts are demanding. The embodiments described above allow for a homogenous distribution of the grains as well as for an appropriate dust removal and sufficient tensile properties. Moreover, the open structure is extremely useful in certain types of belt sanding machines where the transparency of the belt gives the machine operator a significantly better possibility to control the sanding process, like for instance in the case of stroke sanders.

The invention claimed is:

1. An abrasive disc comprising:

a textile fabric being formed of interconnected fabric yarns, the textile fabric being defined by beams, each of the beams being defined by multiple interconnected fabric yarns, the beams extending between and defining connection regions in which different ones of the beams connect with each other, the interconnected fabric yarns in each one of the beams being knitted, stitched, or woven between the connection regions, wherein at least some of the beams extend in a direction intersecting a machine direction of the abrasive disc; and wherein the textile fabric comprises on one side thereof a coherent abrasive area and the coherent abrasive area comprises a plurality of regularly distributed openings in the form of through holes, each perimeter portion of each respective one of the through holes being defined by one of the connection regions or by the interconnected fabric yarns that are knitted, stitched, or woven in one of the beams extending between two of the connection regions that define perimeter portions of the respective one of the through holes.

2. The abrasive disc of claim 1, wherein the beams extending in a direction intersecting the machine direction of the abrasive disc result in adjacent openings being offset relative to each other in the machine direction.

3. The abrasive disc of claim 1, wherein the beams extending in a direction intersecting the machine direction of the abrasive disc result in the openings of subsequent rows to overlap in the machine direction.

4. The abrasive disc according to claim 1, wherein a ratio of a volume of the interconnected fabric yarns to a volume of the abrasive disc, not including the openings, is 0.1:1 to 0.9:1.

5. The abrasive disc according to claim 1, wherein a ratio of a volume of the fabric yarns to a volume of the abrasive disc, not including the openings, is 0.4:1 to 0.8:1.

6. The abrasive disc according to claim 1, wherein the coherent abrasive area on the one side of the textile fabric comprises a coating applied to the one side of the textile fabric.

7. The abrasive disc according to claim 1, wherein the thickness of each of the interconnected fabric yarns is between 5 to 4000 dtex.

8. The abrasive disc according to claim 1, wherein the perimeter portions defined by the connection regions or by the interconnected fabric yarns of each respective one of the through holes have the form of an equilateral quadrilateral or are of hexagonal shape.

9. The abrasive disc according to claim 1, wherein the openings have a long dimension and a short dimension, the long dimension extending in the machine direction of the abrasive disc.

10. The abrasive disc according to claim 1, wherein a largest diameter of the openings is 0.3 mm to 20 mm.

11. The abrasive disc according to claim 1, wherein the beams separate neighboring openings.

12. The abrasive disc according to claim 1, wherein a number of interconnected fabric yarns crossing at the connection regions of the interconnected fabric yarns is constant throughout the abrasive disc.

13. The abrasive disc according to claim 1, wherein the textile fabric has an atlas or cord structure.

14. The abrasive disc according to claim 1, further comprising reinforcing yarns worked into the textile fabric, the reinforcing yarns having a different thickness than the fabric yarns.

15. The abrasive disc according to claim 14, wherein the reinforcing yarns are worked into the textile fabric in the form of a pillar stitch.

16. The abrasive disc according to claim 14, wherein each of the reinforcing yarns have a thickness of between 1 and 1/20 times the thickness of each of the fabric yarns.

17. The abrasive disc according to claim 14, wherein the reinforcing yarns are worked into the beams.

18. The abrasive disc according to claim 1, wherein the textile fabric is impregnated with an impregnation and the textile fabric is tensed when applying and/or curing the impregnation.

19. The abrasive disc according to claim 1, wherein a total area of the openings is 0.1 to 10 times a total surface area of a total coherent abrasive area.

20. The abrasive disc according to claim 1, wherein, when a force of 100N per 50 mm width of a sample length of 200 mm is applied to the textile fabric of the abrasive disc along the machine direction of the abrasive disc, an elongation along the machine direction of the abrasive disc is less than 1%.

21. The abrasive disc of claim 1, wherein an entirety of the textile fabric is defined by only the beams, all of the beams of the textile fabric being transverse to the machine direction of the abrasive disc, the machine direction being defined by a direction in which the abrasive disc is driven to circulate.

22. The abrasive disc of claim 1, wherein the interconnected fabric yarns in each respective one of the beams are knitted, stitched, or woven along an entirety of the respective one of the beams between the connection regions.

23. The abrasive disc of claim 1, wherein the machine direction is the direction, in which the abrasive disc is driven to circulate.

24. The abrasive disc of claim 1, wherein the openings are uniform.

25. The abrasive disc of claim 1, wherein a weight fraction ratio of the textile fabric before being impregnated and the textile fabric after being impregnated is between 0.05:1 and 0.9:1.

26. The abrasive disc of claim 1, wherein a weight fraction ratio of the textile fabric before being impregnated and the textile fabric after being impregnated is between 0.2:1 and 0.4:1.

* * * * *